US007193500B2

(12) United States Patent
Chinthakindi et al.

(10) Patent No.: US 7,193,500 B2
(45) Date of Patent: Mar. 20, 2007

(54) THIN FILM RESISTORS OF DIFFERENT MATERIALS

(75) Inventors: Anil K. Chinthakindi, Fishkill, NY (US); Anita Madan, Danbury, CT (US); Kenneth J. Stein, Newtown, CT (US); Kwong Hon Wong, Wappingers Falls, NY (US)

(73) Assignee: International Business Machines Corporation, Armonk, NY (US)

( * ) Notice: Subject to any disclaimer, the term of this patent is extended or adjusted under 35 U.S.C. 154(b) by 197 days.

(21) Appl. No.: 10/711,460

(22) Filed: Sep. 20, 2004

(65) Prior Publication Data

US 2006/0087400 A1 Apr. 27, 2006

(51) Int. Cl.
*H01C 1/012* (2006.01)

(52) U.S. Cl. ..... 338/314; 338/309

(58) Field of Classification Search ..... 338/48, 338/195, 308–309, 312; 29/621; 438/210, 438/238, 384

See application file for complete search history.

(56) References Cited

U.S. PATENT DOCUMENTS

| | | | | |
|---|---|---|---|---|
| 3,896,284 | A * | 7/1975 | Holmes | 338/48 |
| 5,367,284 | A | 11/1994 | Morris | |
| 5,485,138 | A | 1/1996 | Morris | |
| 5,675,310 | A * | 10/1997 | Wojnarowski et al. | 338/309 |
| 5,849,623 | A * | 12/1998 | Wojnarowski et al. | 438/382 |
| 6,331,811 | B2 | 12/2001 | Shibuya et al. | |
| 6,645,821 | B2 | 11/2003 | Bailey et al. | |
| 2001/0019301 | A1 | 9/2001 | Shibuya et al. | |
| 2002/0030577 | A1 | 3/2002 | Shibuya et al. | |

* cited by examiner

*Primary Examiner*—Tu Hoang
(74) *Attorney, Agent, or Firm*—Ira D. Blecker

(57) ABSTRACT

An integrated circuit includes a bilayer thin film resistor in which the lower layer is a seed layer that controls the crystal structure of the upper layer. The thickness of the lower layer and the thickness of the upper layer may be chosen to form a resistor with a TCR having a design value.

20 Claims, 3 Drawing Sheets

THIN FILM RESISTORS OF DIFFERENT MATERIALS

BACKGROUND OF INVENTION

1. Technical Field

The field of the invention is that of integrated circuit fabrication, in particular forming thin film resistors integrated into the back end process and having a resistance value that is stable under temperature changes.

2. Background of the Invention

Thin film resistors are utilized in electronic circuits in many important technological applications. The resistors may be part of an individual device, or may be part of a complex hybrid circuit or integrated circuit. Some specific examples of thin film resistors in integrated circuits are the resistive ladder network in an analog-to-digital converter, and current limiting and load resistors in emitter follower amplifiers.

Film resistors can comprise a variety of materials including tantalum nitride (TaN), silicon chromium (SiCr), and nickel chromium (NiCr). These resistor materials are generally evaporated or sputtered onto a substrate wafer at a metal interconnect level and subsequently patterned and etched. The thin film resistors require an electrical connection to be made to them and generally the performance of the resistors is related to the condition and cleanliness of the resistor surface and the integrity of the electrical connection. It is well known that contaminants incorporated in the resistor material and around the electrical interconnects can have adverse effects on the resistor performance. It is important to ensure that during the manufacturing process, the resistor surface is not exposed to materials and chemicals likely to leave behind contaminants on the resistor surface that will adversely affect either the bulk sheet resistivity or the subsequent interconnect areas.

A well known method of ensuring that the resistor does not come into contact with potential contaminants during processing is to deposit a sacrificial barrier layer, such as titanium(TiW) or other suitable material over the resistor just after it has been deposited. This barrier layer is often referred to as a "hard mask". After the barrier layer and resistor material are patterned and etched, the metal for the metal interconnect is deposited, patterned and etched. The "hard mask" protects the resistor during this processing and is eventually removed by a wet chemical process such as exposure to a hydrogen peroxide (H2O2) solution just before an insulation layer or passivation layer is deposited over the resistor to permanently protect it.

A persistent problem in the art is that the temperature range over which a circuit operates can vary by a large amount and that various electrical parameters are sensitive to temperature changes.

A common technique in the art has been to construct circuits that depend on the ratio of resistors, rather than the absolute value of resistance. The benefit of this has been that it is much easier to control the ratio of areas by lithography, so that the resulting ratio of resistances is insensitive to parameters such as film thickness and film resistivity. This technique requires considerably more area than a single resistor.

In current technology, however, designers are using circuit modules that depend on the value of a resistor more directly.

It is known, for example that TaN deposited on oxide is typically a mixture of hexagonal and cubic phases and has a TCR of −650 ppm/C, which produces a wide variation in operating resistance.

TaN in the cubic phase has a much lower TCR of 300 ppm/C, but it has not been easy (practical) to control the phase of the final film after various further processing steps.

U.S. Pat. No. 6,331,811 shows a thin film resistor made from a matrix of amorphous TiN containing crystals of TiN and Ti.

U.S. Pat. No. 6,645,821 shows an integration scheme for a thin film resistor in which vias are formed simultaneously from an upper level to the resistor and to the substrate on which the resistor rests.

U.S. Pat. No. 5,485,138 shows a structure of a thin film resistor in which the film is deposited above the contacts, thereby removing the problem of etching through an upper protective layer on the top of the resistive film.

The art could benefit from a simple method of forming a thin film resistor having reduced variation in the resistance of the final product.

SUMMARY OF INVENTION

The invention relates to a thin film resistor that is formed from two layers—a seed layer that controls the crystal structure of the main layer and a main layer that provides the resistance.

A feature of the invention is that a thin seed layer of TiN is put down first with a cubic structure to control the crystal structure of the main layer.

Another feature of the invention is that the TaN main layer has a predictable cubic crystal structure when deposited over the TiN seed layer.

Yet another feature of the invention is that the thickness of the TiN layer is less than 20% of the thickness of the TaN layer, so that the TiN does not have a significant affect on the sheet rho or TCR of the final resistor.

DETAILED DESCRIPTION

Figure 1:
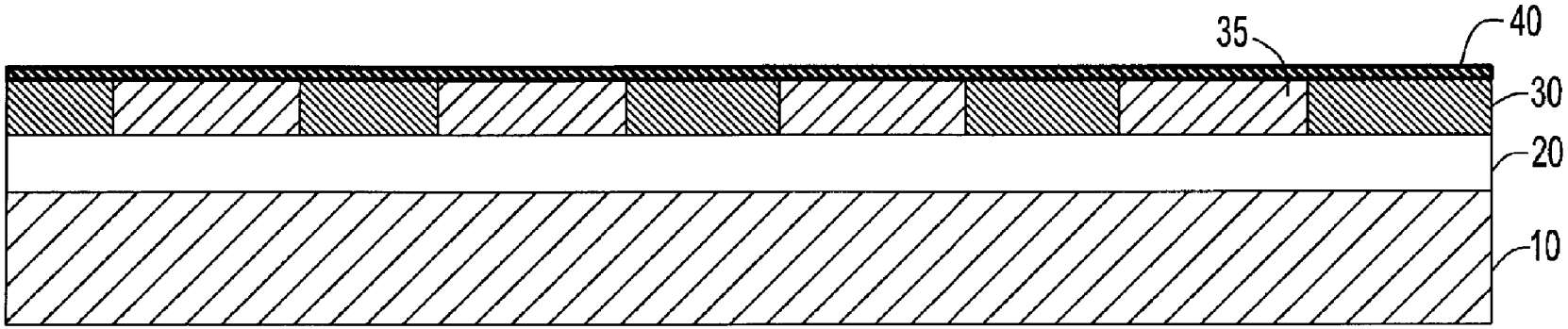
FIG. 1 shows an initial structure for use in a method according to the invention.

FIG. 1 shows a substrate 10, such as silicon, silicon on insulator, silicon-germanium alloy, gallium arsenide, or other semiconductor wafer. Transistors and other circuit elements will be formed in the wafer using conventional processes known to those skilled in the art. Above substrate 10, a layer 20 represents schematically transistors, DRAM cells, and other circuit elements that make up an integrated circuit.

The next layer up, having alternating blocks, represents schematically lower levels of interconnect in the back end technology. Illustratively, blocks 30 represent interlevel dielectric and blocks 35 represent conductors (or other elements of the circuit) that may be included in integrated circuits.

On the top of FIG. 1, layer 40 represents a cap layer of nitride (Si3N4) or other dielectric.

Figure 2:
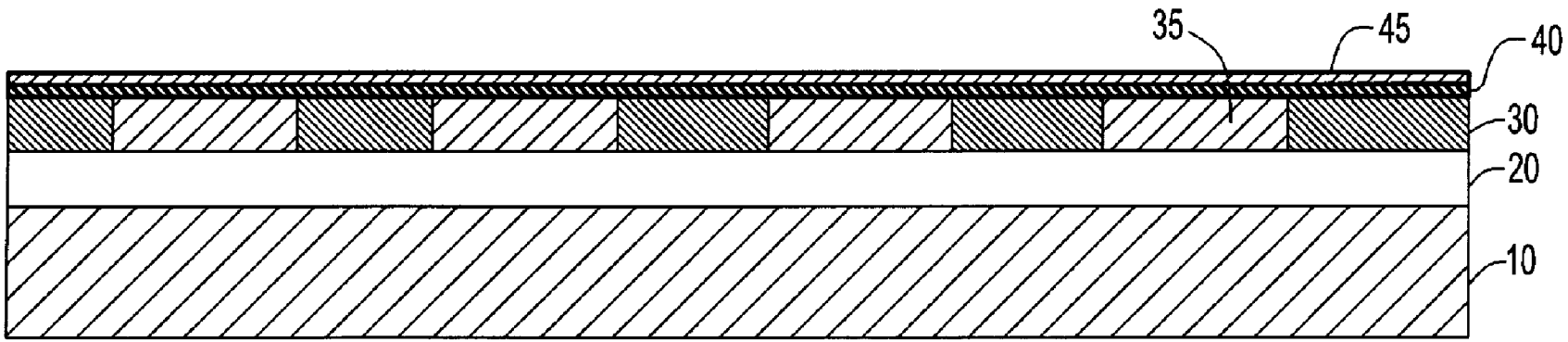
FIG. 2 shows a structure with an oxide dielectric layer for use in a method according to the invention.

FIG. 2 shows the same area of a wafer with the addition of a layer of oxide, illustratively a CVD oxide deposited from silane.

The TiN could be deposited on a layer other than oxide, e.g. nitride, silicon, low-k dielectric, etc.

Figure 3:
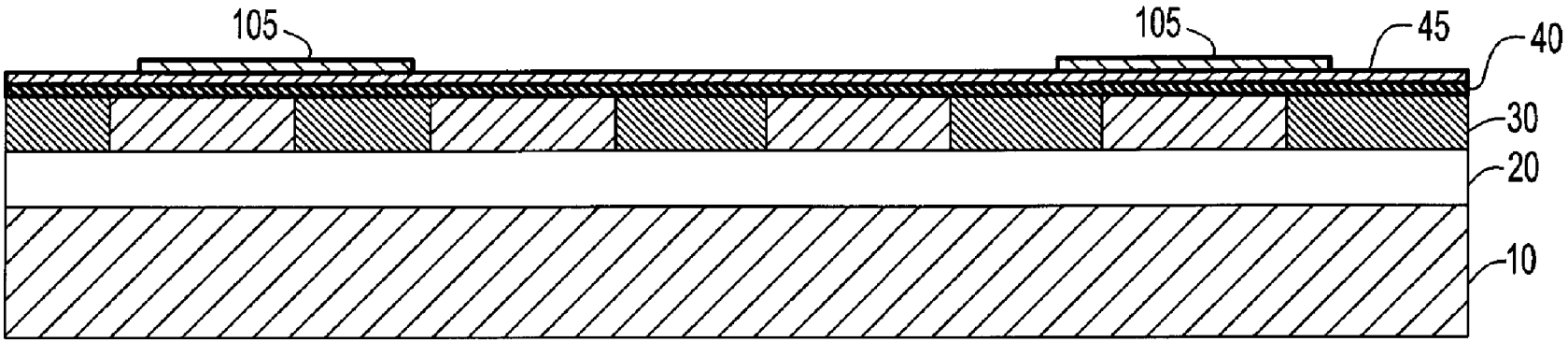
FIG. 3 shows a patterned seed layer for use in a method according to the invention.

FIG. 3 shows the result of depositing a seed layer of TiN and patterning the seed layer to define areas that will use the seed layer in a thin film resistor according to the invention. On the left and the right of the figure, there is an area (pad) 105 of the TiN film. On the left, the final resistor will include a thin layer of TiN below a thicker layer of TaN. The value of the resistance will be determined by the TaN and the TiN is a seed layer that controls the crystal structure of the TaN. On the right, there will be a resistor having a single layer of TiN. In the center, the TiN has been stripped, in an area where there will be a single layer of a TaN film.

Figure 4:
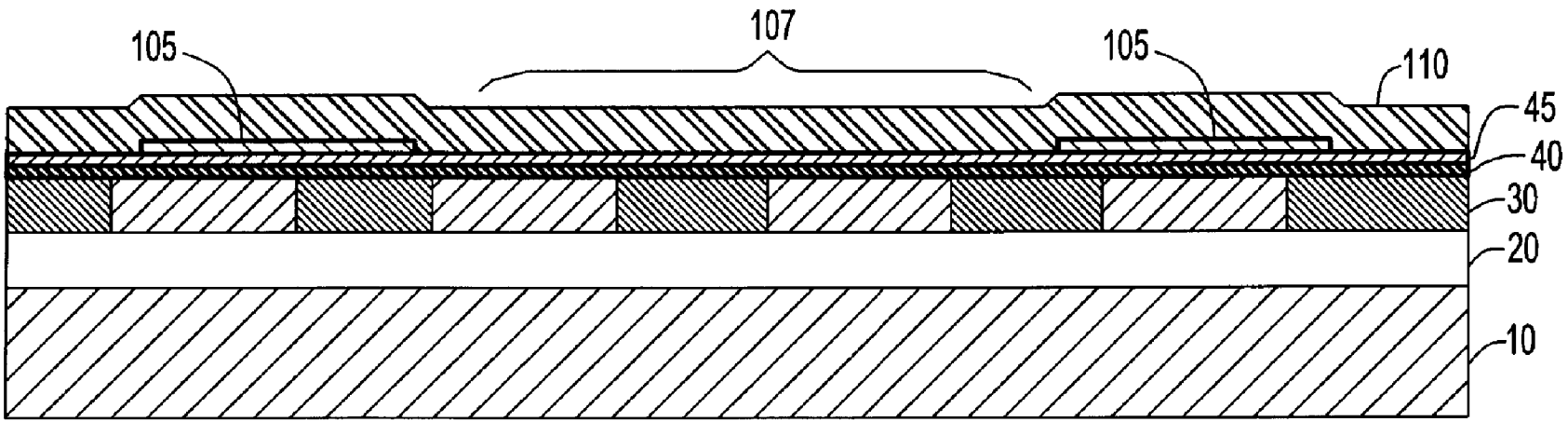
FIG. 4 shows the deposition of the resistor layer.

FIG. 4 shows the result of depositing a layer of TaN over the seed layer. Layer 110 is a layer of TaN that covers two areas 105 of TiN and has an area denoted by bracket 107 that will be a resistor consisting of a single layer of TaN.

Above the TiN, the effect of the seed layer is felt and the TaN is constrained to be cubic, rather than a mixture of hexagonal and cubic phases. Where the TaN lies directly on the oxide, the influence of the TiN seed layer will be felt only within a relatively short distance from the area of layers 105. Outside that area, the TaN will be a mixture of hexagonal and cubic phases.

It is an advantageous aspect of the invention that the predictability of the crystal structure of the TaN film provides consistency and reliability to the resistors.

Figure 5:
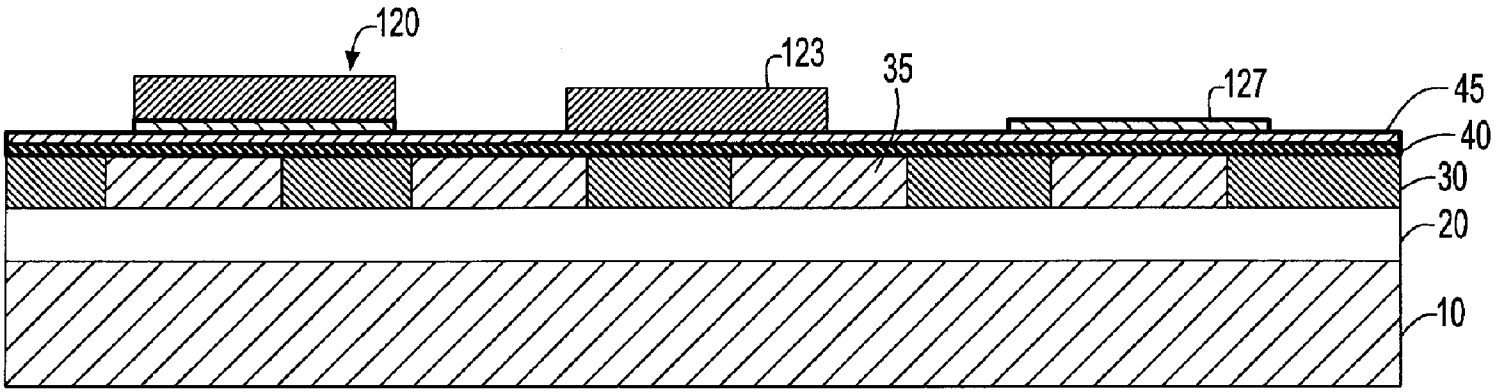
FIG. 5 shows the patterning of the resistor layer to define three types of resistor.

FIG. 5 shows the result of patterning the TaN layer to define three types of resistor. The first type of resistor, denoted with numeral 120, is a seed layer of TiN below in contact with oxide 45 and the resistor layer of TaN above. Illustratively, the TiN has a thickness 10% that of the TaN, but no more than 20% of the TaN.

The second type of resistor, denoted with numeral 123, is a layer of TaN that is deposited directly on oxide 45.

The third type of resistor, denoted with numeral 127, is a layer of TiN without the TaN resistor layer. Since the TiN layer is relatively thin, this type of resistor film is better suited for resistors having a relatively small total value, where variations in the size of the resistive material will have a smaller effect that the same variations in a material having a larger bulk resistivity.

The results of FIG. 5 were obtained by depositing a TiN film on oxide 45, patterning it in a Fluorine RIE (CHF3, CF4 chemistry) to leave the two pads 105 as shown in FIG. 3. The TaN film was patterned to remove the TaN selective to TiN in a Chlorine RIE (Cl2, BCl3 chemistry). In addition to improve the selectivity of TaN over TiN metal, a metal hardmask (made of insulating material such as SiN or SiCN) can be deposited only over TiN over Pad 127.

Figure 6:
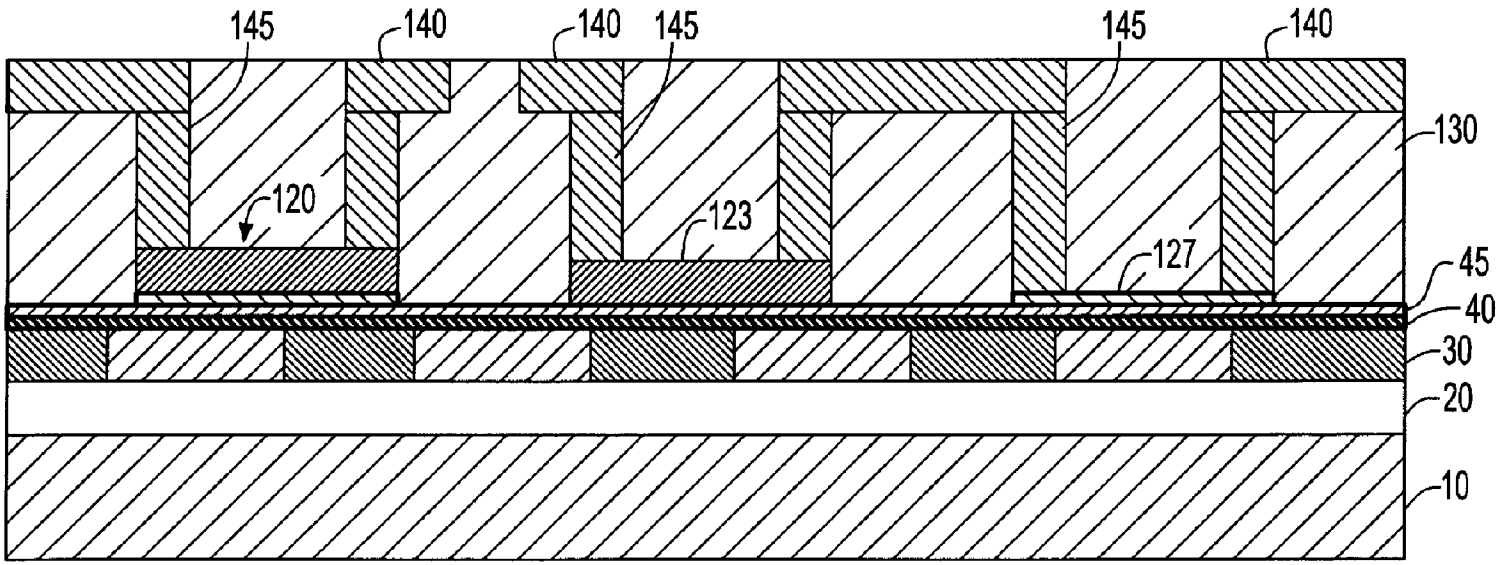
FIG. 6 shows three types of resistor formed according to the invention.

FIG. 6 shows the result of depositing a layer of interlevel dielectric 130, such as oxide or low-k dielectric, and forming a dual-damascene set of contacts that connect the resistor films to other circuit elements. Vertical connections members 145 are formed through the dielectric and connected horizontally by interconnect 140.

In the field of forming integrated circuits, it is known that resistance changes with temperature, as well as with other factors. The change of resistance with temperature, referred to as TCR, is known to be −600 ppm/C for bulk TaN (which has a mixture of cubic and hex phase) and to be +275 ppm/C for bulk TiN (which has a cubic phase).

In a particular application, it was desired to have resistor films with a sheet resistivity (sheet rho) of 142 ohms/sq (with "sq" meaning square micron) and with a TCR as small as possible. The preferred embodiment of the invention does not provide adjustment of the thicknesses of the materials to control the net TCR, but is some applications there may be a benefit to a low TCR that compensates for the constraints on the value of the resistor that result from giving priority to the TCR.

In the case of a bilayer resistor film, the two films can be considered to be in parallel, so that the effective resistance for the combination is:

$$R_{eff}=R_1R_2/(R_1+R_2).$$

The TCR is defined as the normalized first derivative of resistance with temperature:

$$TCR_{eff}/R_{eff}=(TCR_1/R_1)+(TCR_2/R_2)$$

Table I illustrates the results of calculating the combined resistance of a bilayer of a TaN film and a TiN film. The columns for R1 and R2 represent a thickness in nanometers and the columns for TCR1 and TCR2 are in ppm/C.

TABLE I

| R1 TaN | TCR1 (TaN) | R2 (TiN) | TCR2 (TiN) | R (ohms/sq) | TCR (ppm/C) |
|---|---|---|---|---|---|
| 5 | −600 | 20 | 225 | 40 | −435 |
| 10 | −600 | 20 | 225 | 66.67 | −325 |
| 15 | −600 | 20 | 225 | 85.71 | −246.43 |
| 20 | −600 | 20 | 225 | 100 | −187.5 |
| 30 | −600 | 30 | 225 | 150 | −187.5 |
| 25 | −600 | 30 | 225 | 136.36 | −225 |
| 28 | −600 | 30 | 225 | 144.83 | −201.72 |
| 50 | −600 | 20 | 225 | 142.86 | −10.71 |
| 45 | −600 | 20 | 225 | 138.46 | −28.85 |
| 55 | −600 | 20 | 225 | 146.67 | 5 |
| 30 | −600 | 30 | 225 | 150 | −187.5 |

The predictions in Table I do not consider whether the TiN is below or above the TaN.

An experimental run was made to test the predictions of the model above. It was unexpectedly found that the sheet rho depended on the sequence of films. It made a difference whether the TiN was below or above the TaN.

Wafers were defined for resistors of varying sizes. The resistors formed in the wafers were tested at different temperatures: −55 C, 0 C, 25 C, 85 C, 125 C and 200 C.

Different current densities were passed through the test resistors from 0 up to 0.01 mA/micron, with intervals of 0.003 mA/micron.

Sample resistor sizes were 5×2.5, 5×12.5, 5×25, 10×5, 20×10 and 20×50 (micron×micron).

The bilayer TiN/TaN film was deposited by reactive magnetron sputtering in an Argon-Nitrogen atmosphere. Sputtering was sequential, with and without an air break. For TiN, the typical nitrogen to argon gas mixture ranged from 3:1 to 5:1, with 4:1 being preferred. Total chamber pressure was in the range of 2 mT to 20 mT. Temperature of deposition ranged from 40 C to 100 C.

Illustratively, according to the invention, the TiN functions as a seed layer to ensure that the TaN is cubic. The value of the sheet rho for the combination of the TiN and TaN is primarily determined by the TaN, which in the cubic form has a sheet rho of 55 Ohm/sq and a TCR of −300 ppm/C. The sheet rho of a mixture of hexagonal and cubic crystals will vary, giving rise to undesirable variations in the magnitude of the resistors.

The thickness of the lower layer and the upper layer was selected in consideration of the formula such that the sheet rho and the TCR were within the design value; i.e. the thickness of the TiN and the TaN were adapted to produce the final value of sheet rho. The value of the resistor was then determined by the size of the resistor material.

TABLE II

| Wafer | R1 TaN | TCR1 TaN | R2 TiN | TCR2 TiN | $R_{test}$ | $R_{model}$ | $TCR_{model}$ | $TCR_{test}$ |
|---|---|---|---|---|---|---|---|---|
| 10 nm TaN/ 10 nm TiN | 542 | −673 | 176 | 289 | 120 | 132.9 | 53.2 | 177.3 |
| 12.5 nm TiN/ 10 nm TaN | 542 | −673 | 132 | 132 | 361 | 106.1 | 158.5 | 96. |
| 10 nm TiN/ 10 nm TaN | 542 | −673 | 176 | 176 | 289 | 132.9 | 53.2 | 57.3 |

The data of TABLE II indicate the unexpected result that the sheet rho and the TCR of a TiN/TaN bilayer depend on the order of deposition.

In the first row, with a TaN bottom layer, the resistance (sheet rho) is 120 ohms/sq and the TCR is 177 ppm/C. In the third row, with films of the same thickness, but the opposite sequence, the resistance is 110 ohms/sq and the TCR is 57 ppm/C—about ⅓ of the value of the other configuration. The model gives identical results for the resistance and for the TCR for these two cases.

In order to identify the source of this discrepancy, the films were examined by X-ray diffraction.

With the deposition conditions indicated above, the X-ray analysis indicated that the TiN film was cubic, whether the TiN film was deposited on the oxide lower layer or on a lower layer of TaN.

In contrast, the structure of the TaN film was controlled by the TiN film. When the lower film was TaN, its structure was a mixture of cubic and hexagonal crystals. When the TaN film was deposited on the TiN lower film, the TaN film was always cubic, over a broad range of TiN thicknesses.

The TaN film was deposited with an argon to nitrogen ratio of 1.5 to 3, preferably 2 to 2.5. Chamber pressure was in the range of 2 to 20 mT. Temperature of deposition ranged from 40 C to 200 C.

The TCR of the bilayer TiN/TaN film is higher than that of the TaN/TiN film.

Thickness of the TiN seed layer is between 2 nm to 20 nm, preferably around 4 nm to 10 nm.

Thickness of the TaN film was from 20 nm to 100 nm, preferably 40 nm to 70 nm.

In the particular application used as an example, a sheet resistance of 142 ohm/sq is produced with a TiN film of 244 ohms/sq (or 7.2 nm) and a TaN film above the TiN of 575 ohms/sq (or 9.4 nm). The TCR of this combination is calculated to be 2.4 ppm/C. Those skilled in the art will readily be able to modify the thicknesses shown in order to produce films to suit their purposes.

Referring back to FIG. 6, Resistor 1 (numeral 120) will have a cubic crystal structure in both layers, as described above. Resistor 2 (numeral 123) will be a single layer of TaN with a mixture of cubic and hexagonal phases, since it was deposited directly on the oxide 45. Resistor 3 (numeral 127) will be a single layer of TiN having cubic structure, since it was in contact with the TaN before the TaN was stripped.

The resistor 1 may be constructed to have a small TCR, in which case, resistors 2 and 3 will have TCRs of larger magnitude.

Those skilled in the art will appreciate that the method disclosed herein may be applied to an integrated circuit in which: 1) all of the resistors are bilayer; 2) some are bilayer and some are single-layer TaN; 3) some are bilayer and some are single-layer TiN; or 4) all three types are present as shown in FIG. 6.

It will also be evident that the designer may vary the size of the various resistors to compensate for a value of sheet rho in one of the resistor types that is determined by the requirements of resistor 1.

The interconnections may be aluminum or copper, with appropriate liners to prevent diffusion of copper. Conventional barrier layers on the bottom of vias 145 may be used to improve adhesion and/or prevent diffusion. Connections to the resistors may be made by a dual-damascene connection as shown, from a lower level, from both a lower level and from an upper level, so that the resistor also connects levels, or by a number of other connection structures.

The etching steps to pattern the films and to remove the TaN selective to the TiN are conventional, well known to those skilled in the art.

Although the invention has been illustrated in terms of TiN and TaN, other materials may be used that satisfy the criterion that the first material controls the crystal structure of the second material and that the second material has two or more alternative structures that differ in resistivity, TCR or some other relevant parameter.

For example, the seed material may be TiN, Ta, Ti, W, WN, Al2O3, TaO or a number of other materials. The thicker resistive material may be TaN, TiN, SiCr, WN, W. The thicker material is different from the seed material.

While the invention has been described in terms of a single preferred embodiment, those skilled in the art will recognize that the invention can be practiced in various versions within the spirit and scope of the following claims.

What is claimed is:

1. A method of forming a resistor disposed on a substrate comprising the steps of:

depositing a first seed layer of a first resistive material on said substrate with a first thickness and a first crystal structure;

depositing a second layer of a second resistive material different from said first resistive material on said substrate with a second thickness and a second crystal structure such that said second crystal structure is controlled by said first crystal structure; and patterning said first and second layers of resistive material to define a resistor.

2. A method according to claim 1, in which said first resistive material is selected from the group including TiN, Ta, Ti, W, WN, Al2O3, and TaO and said second resistive material is selected from the group including TaN, TiN, SiCr, WN and W.

3. A method according to claim 2, in which said first thickness is less than 20% of said second thickness.

4. A method according to claim 1, further comprising a step of patterning said first resistive material to form at least two pads; and said second layer of resistive material is not formed over at least a selected one of said at least two pads, whereby a single-layer resistor is formed from said selected one of said at least two pads.

5. A method according to claim 3, further comprising a step of patterning said first resistive material to form at least two pads; and said second resistive material is not formed over at least a selected one of said at least two pads of said first resistive material, whereby a single-layer resistor of said first resistive material is formed from said selected one of said at least two pads.

6. A method according to claim 1, in which said second resistive material is disposed in at least two locations, a first location disposed above said first layer of resistive material and a second location disposed directly on said substrate, whereby a single-layer resistor is formed from said second resistive material in said second location.

7. A method according to claim 3, in which said second resistive material is disposed in at least two locations, a first location disposed above said first resistive material and a second location disposed directly on said substrate, whereby a single-layer resistor is formed from said second resistive material in said second location.

8. A method according to claim 3, in which said second resistive material is disposed in at least three locations, a first location disposed above a pad of said first layer of resistive material and a second location disposed directly on said substrate, whereby a single-layer resistor is formed from said second resistive material in said second location, a single-layer resistor is formed from said first resistive material in said selected one of said at least two pads and a controlled structure resistor is formed from said second resistive material disposed above said first resistive material.

9. A method according to claim 2, in which a TiN layer is deposited at a temperature between 40 C and 100 C in an argon: nitrogen mixture in the range 3:1 to 5:1.

10. A method according to claim 2, in which a TaN layer is deposited at a temperature between 40 C and 200 C in an argon: nitrogen mixture in the range 1.5:1 to 3:1.

11. A method of forming at least two types of resistors disposed on a substrate comprising the steps of:

depositing a first layer of a first resistive material on said substrate with a first thickness and a first crystal structure;

patterning said first layer of resistive material to form at least two pads;

depositing a second layer of a second resistive material different from said first resistive material on said substrate with a second thickness and a second crystal structure such that said second crystal structure is controlled by said first crystal structure and said second thickness is adapted to combine with said first thickness to generate a final sheet resistivity having a design value;

patterning said second layer of resistive material to remove said second layer of resistive material above at least one of said at least two pads, whereby a first type of resistor is formed from a bilayer of said first resistive material and said second resistive material and a second type of resistor is formed from said first resistive material only without said second resistive material.

12. A method according to claim 11, in which said first resistive material is selected from the group including TiN, Ta, Ti, W, WN, Al2O3, and TaO and said second resistive material is selected from the group including TaN, TiN, SiCr, WN and W.

13. A method according to claim 11, in which said step of patterning said second layer of resistive material comprises patterning an area of said second resistive material over a portion of said substrate that does not have a pad of said first resistive material, thereby forming a third type of resistor of said second resistive material without said first resistive material.

14. An integrated circuit comprising at least one resistor of a first resistor type disposed on a substrate comprising:

a first layer of a first resistive material deposited on said substrate with a first thickness and a first crystal structure;

a second layer of a second resistive material different from said first resistive material deposited on said substrate above at least said first layer of resistive material with a second thickness and a second crystal structure such that said second crystal structure is controlled by said first crystal structure and said second thickness is adapted to combine with said first thickness to generate a final change of resistance with temperature having a design value.

15. An integrated circuit according to claim 14, in which said first resistive material is selected from the group including TiN, Ta, Ti, W, WN, Al2O3, and TaO and said second resistive material is selected from the group including TaN, TiN, SiCr, WN and W.

16. An integrated circuit according to claim 14, in which said first thickness is less than 20% of said second thickness.

17. An integrated circuit according to claim 14, further comprising a second resistor of a second resistor type comprising a single layer of said first resistive material.

18. An integrated circuit according to claim 14, further comprising a resistor of a third resistor type comprising a single layer of said second resistive material.

19. An integrated circuit according to claim 16, further comprising a resistor of a third resistor type comprising a single layer of said second resistive material, whereby said integrated circuit includes a bilayer resistor and two types of single layer resistor.

20. An integrated circuit according to claim 16, in which said first resistive material is selected from the group including TiN, Ta, Ti, W, WN, Al2O3, and TaO and said second resistive material is selected from the group including TaN, TiN, SiCr, WN and W.

* * * * *